US005897474A

United States Patent [19]

Romero

[11] Patent Number: 5,897,474

[45] Date of Patent: Apr. 27, 1999

[54] BALANCING AND EXERCISING DEVICE

[76] Inventor: Ron Richard Romero, 2147 Newcastle Ave., Cardiff, Calif. 92007

[21] Appl. No.: 09/019,276

[22] Filed: Feb. 5, 1998

[51] Int. Cl.[6] ..... A63B 22/16; A63B 23/08; A63H 13/18

[52] U.S. Cl. ..... 482/146; 482/79; 446/396

[58] Field of Search ..... 482/146, 79; 446/396, 446/325

[56] References Cited

U.S. PATENT DOCUMENTS

| | | | |
|---|---|---|---|
| 2,930,613 | 10/1960 | Katz | 482/146 |
| 3,024,021 | 3/1962 | Coplin et al. . | |
| 3,298,687 | 1/1967 | Douglas . | |
| 3,604,726 | 9/1971 | Tracy . | |
| 3,716,229 | 2/1973 | Van Der Clevan . | |
| 3,806,116 | 4/1974 | Malmberg et al. . | |
| 3,862,768 | 1/1975 | England . | |
| 3,984,100 | 10/1976 | Firster . | |
| 4,191,371 | 3/1980 | Armer | 482/146 |
| 4,491,318 | 1/1985 | Francke . | |
| 4,653,748 | 3/1987 | Seel et al. . | |
| 4,817,950 | 4/1989 | Goo . | |
| 5,062,629 | 11/1991 | Vaughan . | |
| 5,203,279 | 4/1993 | Eversdyk | 482/146 |
| 5,328,421 | 7/1994 | Stanalajczo . | |
| 5,342,266 | 8/1994 | Daily . | |
| 5,399,140 | 3/1995 | Klippel . | |
| 5,545,115 | 8/1996 | Corcoran | 482/146 |
| 5,643,154 | 7/1997 | Awbrey | 482/146 |
| 5,643,164 | 7/1997 | Teff | 482/146 |
| 5,647,830 | 7/1997 | Togao | 482/146 |
| 5,797,277 | 8/1998 | Bruntmeyer | 482/146 |
| 5,810,703 | 9/1998 | Stack | 482/146 |

FOREIGN PATENT DOCUMENTS

| | | |
|---|---|---|
| 3620-706 | 12/1987 | Germany . |
| PCTW09408664 | 4/1994 | WIPO . |

*Primary Examiner*—Stephen R. Crow
*Assistant Examiner*—William La Marca
*Attorney, Agent, or Firm*—Thomas I. Rozsa; Tony D. Chen; Jerry Fong

[57] ABSTRACT

A unique biomechanical balancing and exercising device for rehabilitating body muscles, tendons, ligaments and joints in the ankles, legs, knees, and back in order to strengthen these areas to prevent injury. The balancing and exercising device comprises a rectangular shaped platform with a central opening therethrough to accommodate a semi flexible ball member. The platform utilizes a semi flexible ball member so that the individual has the ability to balance in numerous directions and have the angle of drop much steeper. A pair of ball-shaped rigid members are mounted on the platform and located adjacent to and on opposite sides of the central opening for balancing on and securing the semi flexible ball member therebetween. The platform is placed on top of the semi flexible ball member such that the central opening accommodates a top portion of the semi flexible ball member, and thereby allows the platform to be independently tilted or pivoted front-to-back up to a 25° angle and vice versa and side-to-side approximately up to a 50° angle.

12 Claims, 3 Drawing Sheets

BALANCING AND EXERCISING DEVICE

BACKGROUND OF THE INVENTION

1. Field of the Invention

The present invention generally relates to the field of exercise devices. More particularly, the present invention relates to the field of balancing and exercising boards.

2. Description of the Prior Art

It is well known in the art that balancing and exercising devices consist of a disk or a square shaped object which has one or more holes in the disk to accommodate a balancing means such as a circular ball. In most cases, the balls are made of hard material such as wood and do not have any resilience in them, and therefore are harder to balance and harder to simulate a sports action, and therefore the disk and ball do less to truly assist in stimulation of proprioceptors (little sensors at the end of the nerves) in the muscles, tendons, and joints. Other types of prior art devices comprise a ball or a hemispherical object which is screwed onto the bottom of the plate and the individual balances thereon. Another prior art device is a ball which is a separate item from the plate and fits into an opening within the plate on which to balance. The disadvantage with these prior art devices is that if someone stands on the prior art plates and it tilts all the way to the left or right sides of the plate, the side of the plate touching the ground forms an angle approximately in a range of 5° to 15° for a circular object and when a square shaped object is used, the angle once again is typically approximately 20°, in which the angle of drop is not steep at all, and thereby does not provide enough stimulation of proprioceptors in the muscles, tendons, and joints.

The following sixteen (16) prior art patents are found to be pertinent to the field of the present invention:

1. U.S. Pat. No. 3,024,021 issued to Coplin et al. on Mar. 6, 1962 for "Amusement And Exercising Toy" (hereafter the "Coplin Patent");

2. U.S. Pat. No. 3,298,687 issued to Douglas on Jan. 17, 1967 for "Manually Operated Therapeutic Roller And Exercising Device" (hereafter the "Douglas Patent");

3. U.S. Pat. No. 3,716,229 issued to Van Der Cleyen et al. on Feb. 13, 1973 for "Recreational Apparatus" (hereafter the "Van Der Cleyen Patent");

4. U.S. Pat. No. 3,806,116 issued to Malmberg et al. on Apr. 23, 1974 for "Balancing Device"(hereafter the "Malmberg Patent");

5. U.S. Pat. No. 3,862,768 issued to England on Jan. 28, 1975 for "Rollable Fulcrum Balancing Board Recreational And Exercise Device Provided With Non-Linear Stabilization Features" (hereafter the "England Patent");

6. U.S. Pat. No. 3,984,100 issued to Firster on Oct. 5, 1976 for "Exerciser Apparatus For The Human Extremities" (hereafter the "Firster Patent");

7. U.S. Pat. No. 3,604,726 issued to Tracy on Sep. 14, 1971 for "Balance Ball For Amusement And Exercise" (hereafter the "Tracy Patent");

8. U.S. Pat. No. 4,491,318 issued to Francke on Jan. 1, 1985 for "Variable Speed Balance Or Teeter Board" (hereafter the "Francke Patent");

9. U.S. Pat. No. 4,653,748 issued to Seel et al. on Mar. 31, 1987 for "Biomechanical Ankle Platform" (hereafter the "Seel Patent");

10. U.S. Pat. No. 4,817,950 issued to Goo on Apr. 4, 1989 for "Video Game Control Unit And Attitude Sensor" (hereafter the "Goo Patent");

11. U.S. Pat. No. 5,062,629 issued to Vaughan on Nov. 5, 1991 for "Surfing Simulator" (hereafter the "Vaughan Patent");

12. U.S. Pat. No. 5,328,421 issued to Stanalajczo on Jul. 12, 1994 for "Closed Kinetic Chain Exercise Device And Method" (hereafter the "Stanalajczo Patent");

13. U.S. Pat. No. 5,342,266 issued to Dailey on Aug. 30, 1994 for "Slalom Ski Trainer" (hereafter the "Dailey Patent");

14. U.S. Pat. No. 5,399,140 issued to Klippel on Mar. 21, 1995 for "Balancing Sport Board" (hereafter the "Klippel Patent");

15. Patent Cooperation Treaty (PCT) No. WO 94/08664 issued to Smith on Apr. 28, 1994 for "Apparatus And Method For Developing Balancing Skills" (hereafter the "Smith Patent"); and 16. German Patent No. DE 3620-706 for "Sports Or Therapy Appliance-Consists Of Flat Covering Plate To Which Faceted Base Is Fixed" (hereafter the "'706 German Patent").

The Coplin Patent discloses an amusement and exercising toy. It comprises a base member which is in the form of a ball. A standing plate is supported on top of the base member by a rubber pad. The rubber pad is disposed in a rounded indentation in the plate for receiving the rubber pad and the ball. The large ball makes the plate too easy to balance. In addition, the degree of tilt for this plate is approximately 5° to 15° at most. Therefore, there is less muscle activation.

The Douglas Patent discloses a manually operated therapeutic roller and exercising device. It comprises a cylindrical roller which is covered by a flexible material with a hollow shaft disposed in an axial passage of the roller and supported by the roller for rotation of the shaft relative to the roller. The shaft extends from both ends of the roller to provide hand grips. An extensible device is disposed in part within the shaft and has two pulling handles and an elastic cord for pulling each handle.

The Van Der Cleyen discloses a recreational apparatus. It comprises a hollow inflated resilient ball and an annular foot support which encircles the inflated ball. The apparatus is assembled by positioning the deflated ball within the annular platform and then inflating the ball until the ball fits tightly within the annular platform and constricted thereby, so as to bulge out on either side of the platform. An individual stands on top of the platform to bounce the apparatus on the floor surface and therefore the apparatus is used for bouncing and not balancing. The device is strictly used as a recreational toy on which to bounce up and down and cannot be used as a balancing device from which to build muscle.

The Malmberg Patent discloses a balancing device which comprises a rigid platform with a plurality of recesses of different configurations and a solid spherical support member for supporting the platform. The platform is preferably circular shaped with a 24 inch diameter. The Malmberg's device is too hard to operate to combine balancing and spinning at the same time as well as rolling or moving to simulate a sport. In addition, the degree of tilt for the platform is approximately 5° to 15° at most.

The England Patent discloses a rollable fulcrum balancing board recreational and exercise device provided with non-linear stabilization features. The rollable fulcrum is confined within a cavity formed by a protuberant center portion occupying about two-thirds of the length of the balancing board. The balancing board is constructed to resemble a sombrero hat and adapted to balance and ride on a spherically-shaped fulcrum. The relative action between the curved bearing undersurface of the hat shaped balancing board and the fulcrum ball is retarded or slowed in part by the special shape of the concave dome shaped undersurface of the hat shaped balancing board and is slowed or controlled in part by the ratio of the radii of curvature of the concave undersurface to the radius of the sphere shaped fulcrum ball. The balancing board has a degree of tilt, which is approximately 5° to 10°. Further, the device is on a rollable fulcrum which makes it difficult to simulate a sport.

The Firster Patent discloses an exerciser apparatus for the human extremities. It comprises a platform and a rounded member which is ball-like and is attached to the platform by a threaded stud. An attachment rests on the top surface of the platform and is a wedge-like element that places a foot at an angle to the top surface of the platform.

The Tracy Patent discloses a balance ball for amusement and exercise. It comprises a disk-shaped platform on a freely rotatable ball and a dome-shaped housing extends over the rotatable ball, where the rotatable ball engages with ball bearings for allowing the platform to move. Secured to the housing is the disk-shaped platform on which the user stands.

The Francke Patent discloses a variable speed balance or teeter board. It comprises a platform and a fulcrum extending downwardly from the bottom of the platform. Two or more damping members are always attached to the bottom of the platform for controlling the speed of tilt of the platform. There is no skill involved to balance the platform and activation of the leg muscles. It is like riding a bicycle with training wheels. The degree of tilt for the platform is approximately 10° to 15° at most.

The Seel Patent discloses a biomechanical ankle platform. It comprises a flat platform and a hemispherical member secured to the bottom surface of the platform at its diametric planar surface. The platform can only accommodate one foot at a time.

The Goo Patent discloses a video game control unit and attitude sensor. It comprises a surfing video game in which a surfing figure on a monitor moves over simulated waves to gain playing rewards. A foot operated video game controller comprises a surfboard mounted parallel to a supporting surface supported by a suspension system biased to maintain the board in a horizontal position. The suspension system has a fulcrum surrounded by a resilient member, such as an inner tube of a tire or an annular ring of resilient foam, which acts to dampen tilting movement of the platform and to return the platform to a horizontal position. The object is to tilt the mechanism to score points and no real balancing is required. The maximum tilt is approximately 5°.

The Vaughan Patent discloses a surfing simulator. The surfing simulator comprises a ball bearing turntable, an adjustable spring plate assembly, a flexible mounting pad and an elongated contoured riding deck. The riding deck is connected to a stationary supporting base. The user steps onto the riding deck near its center and as the user's feet are moved apart into the surfing stance, the user's weight can be shifted and rotational forces applied to create and sustain a complex rhythmic motion combining spin, tilt and rocking.

The Stanalajczo Patent discloses a closed kinetic exercise device and method. It comprises a support platform including side to side and front to rear enhanced friction surfaces arranged to position the feet of a user with each foot on one side of a pivot plate in a variety of locations on either side and along the length of a pivot plate. The pivot plate has a height that is selected to produce a predetermined angular movement that will translate into a desired manipulation of a particular pair of joints depending upon the positioning of the user's feet at fore and aft and side to side locations on the enhanced friction surfaces. A locking member is directed through the pivot plate and the support platform intermediate the opposite ends thereof, intersecting the curved surfaces to interlock them against fore and aft movements therebetween without constraining pivoting movements therebetween.

The Dailey Patent discloses a slalom ski trainer. It comprises a main channel member with a vertical upright member which is rigidly mounted substantially perpendicular at one end. A ski rope is connected to the vertical upright member at a free end and remote from the main channel member. A ski board is slidably and swivally mounted to the main channel member. A resilient sliding resistance means is attached to the main channel member at a location distal from the vertical upright member and the ski board for the purpose of providing a substantially elastic resistance to the sliding longitudinal displacement of the ski board.

The Klippel Patent discloses a balancing sport board. It comprises an elongated platform for receiving a user. A lower surface of the platform is attached to two sectors which are rotatable about two shafts positioned along a common horizontal axis of rotation. Each shaft is secured about a sector post anchored to a horizontal planar board. The lower surface of the board is attached to a pivot means with the board being pivotable about a vertical axis of rotation. The pivot means is attached to a rectangular plank movable along a linear horizontal axis. Elastic means are attached about the front and rear of the plank and tend to urge the plank toward a center location of the sport platform when used, and thereby the platform is revolvable about horizontal and vertical axes of rotation, and is movable laterally along a linear axes.

The Smith Patent discloses an apparatus and method for developing balancing skills. It comprises a platform and a rod threaded through and perpendicular to the platform.

The German Patent discloses sports or therapy appliance which consists of a flat covering plate to which a faceted base is fixed.

It is desirable to have a very efficient and also very effective design and construction of a balancing and exercising device which enables an individual to achieve a balance comparable to the type of balance that will be needed for surfing and snowboarding. It is also desirable to provide a more difficult device that can be balanced and assimilate sports for activating more muscles than the prior art devices since the angle to the ground can be much steeper than with prior art devices. The balancing and exercising device accomplishes this by activating more proprioceptors, thereby getting muscles to work in cooperation with one another better for good bone movement.

SUMMARY OF THE INVENTION

The present invention is a unique biomechanical balancing and exercising device which can be used in rehabilitation centers to rehabilitate body joints such as ankles, legs, knees, and back in order to strengthen these areas to prevent injury and help the body reach its potential.

Specifically, the present invention balancing and exercising device comprises a rectangular shaped platform with a central opening therethrough to accommodate a semi flexible ball member. By having the generally rectangular shaped platform instead of the round or square platforms, the amount of the angle between the horizontal ground and the side edges of the platform can be extended to approximately 50°. In other words, if an individual is standing on the platform and it tilts all the way to the left or right sides of the platform, the side edge of the platform touching the ground forms an angle of approximately 50°, which is a much steeper angle than is usable with the prior art devices and therefore allows the ankle joints and muscles in the legs to reach their potential and get the benefits of the 50° angle of board tilt for the entire body by changing body foot stance.

With the generally rectangular shaped platform utilizing a semi flexible ball member, the individual has the ability to balance in numerous directions and have the angle of drop at approximately 50° for stretching the muscles, tendons and joints, much steeper than with the ordinary circular or square type platforms. By way of example, a basic stance is to have the individual put his or her feet parallel and spaced apart from each other and 90° to the platform, where the toes face forward and the platform is in a transverse direction. By way of example, another stance is to have the individual put his or her feet parallel and close to each other and parallel to the platform, where the toes face forward and the platform is in a longitudinal direction. The invention facilitates placing two feet at any orientation to activate different proprioceptors. Standing on the platform with a variety of stances will cause an increased number of proprioceptors to be simulated therein and all muscles, tendons and joints will be stretched with a 50° angle of tilt of the balancing board by changing foot stance.

It is therefore an object of the present invention to provide a generally rectangular shaped platform with a central opening therethrough to accommodate a semi flexible ball, so that the amount of the angle between the horizontal ground and the side edges of the platform can be extended to approximately 50°, and thereby create a much steeper angle which is not achievable with the prior art devices. The platform assists the activation of muscles to work in cooperation with one another for good bone movement.

It is an additional object of the present invention to provide a generally rectangular shaped platform which utilizes a balancing means so that the difficulty in balancing the platform can be changed.

It is a further object of the present invention to provided a generally rectangular shaped platform with two opposite retaining and rocking members so that the retaining and rocking members can be utilized to retain the semi flexible ball therebetween and also allows the platform to rock side-to-side without using the semi flexible ball to balance the platform.

The balancing board improves an individual balance for all sports. This is accomplished by activating muscles to work in cooperation with one another for good bone movement. This interaction with the nervous and musculoskeletal systems improves balance, coordination, and quickens reflex time. Standing on the balance board with a variety of stances will cause an increased number of muscles to be stimulated. Upper torso push ups, using the balance board, have the same stimulating effect. The inner ear is also stimulated by movement and this helps develop balance awareness. The increased angle of tilt in all directions of the balance board makes it far superior for muscle, tendon, and joint stretching movements, thereby activating more propriocetors. The end result is that the body is trained to perform better.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
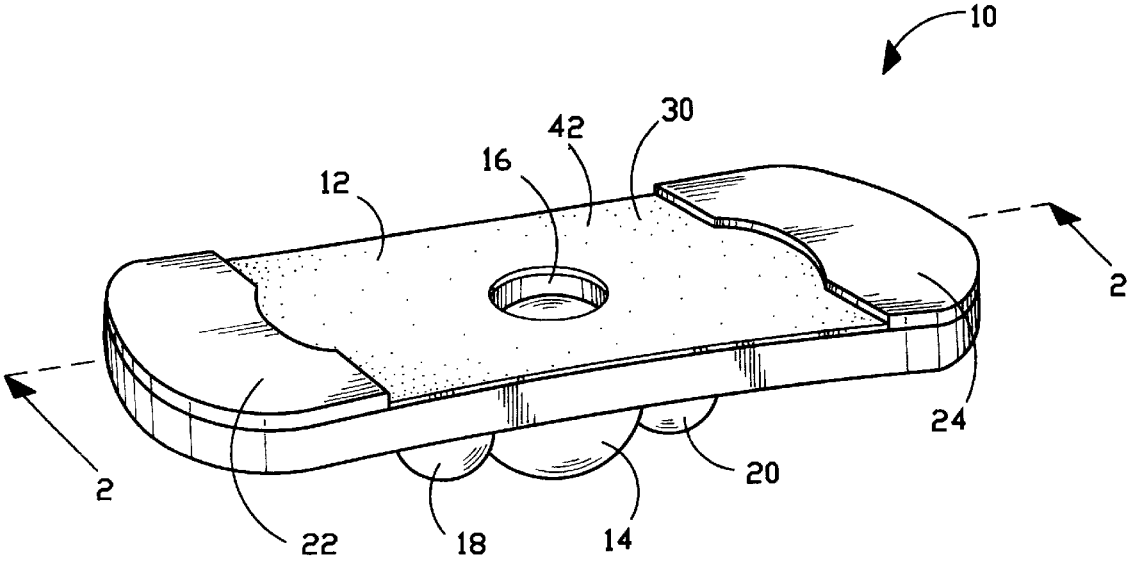
FIG. 1 is a perspective view of the preferred embodiment of the present invention balancing and exercising device.

Referring to FIG. 1, there is shown at 10 a perspective view of the present invention balancing and exercising device. The balancing and exercising device 10 comprises a generally elongated rectangular shaped rigid platform or board 12 and a semi flexible large ball member or pivoting means 14. The rigid platform 12 comprises rounded smooth corners to make it appear like a snowboard, a top side 42, a bottom side 44, and a central opening 16 therethrough for accommodating the semi flexible ball member 14.

Figure 2:
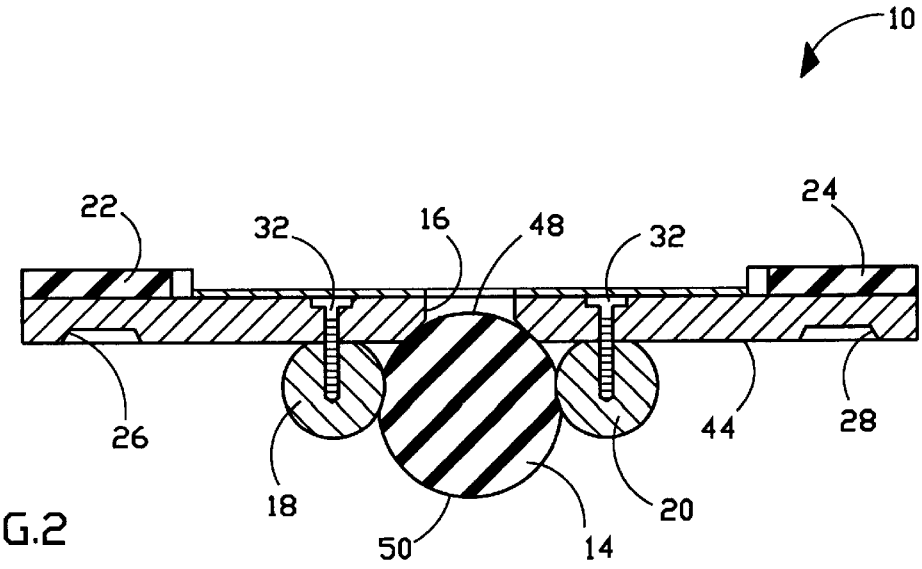
FIG. 2 is a cross-sectional view taken along line 2—2 of FIG. 1.
Figure 3:
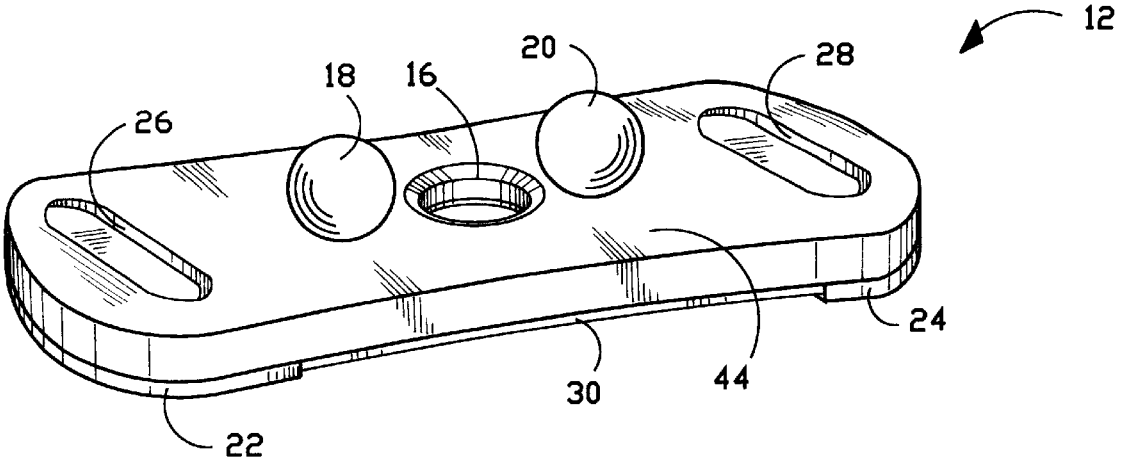
FIG. 3 is a bottom perspective view of the present invention balancing and exercising device without the semi flexible ball.

Referring to FIGS. 2 and 3, there is shown a pair of small ball-shaped rigid members 18 and 20 which are mounted on the bottom side 44 of the platform 12 and located adjacent to and on opposite sides of the central opening 16 for securing the semi flexible ball member 14 therebetween. Each ball-shaped rigid member has a flat portion which abuts against the bottom side 44 of the platform 12 and is secured thereto by a threaded screw 32. The threaded screws 32 are flush with the top surface of the platform 12, and thereby provides a smooth surface for an individual to stand on without any intrusion on the surface. The semi 78 flexible large ball member or pivoting means 14 is press fit between small ball-shaped rigid members 18 and 20 as illustrated in FIG. 2 to add more stability to the pivoting means 14.

The present invention is provided with two opposite hand pads 22 and 24 which are attached to the top side 42 and at opposite ends of the platform 12 for accommodating the user's hands. Two gripping-hand grooves 26 and 28 are also provided with the present invention and are located on the bottom side 44 of the platform 12 in a transverse direction for accommodating the user's fingers and are arranged to correspond with the two opposite hand pads 22 and 24 respectively (see FIG. 6). The surface without the two opposite hand pads 22 and 24 is covered with a very fine sand paper 30 or any suitable means for providing a non slippery surface for an individual to stand thereon (see FIG. 4).

Referring to FIGS. 1 and 2, the platform 12 is placed on top of the semi flexible ball member 14 such that the central opening 16 accommodates a top portion 48 of the semi flexible ball member 14, where the semi flexible ball member 14 is below the top side 42 of the platform 12, and thereby allows the platform 12 to be independently tilted or pivoted front-to-back up to approximately a 25° angle and vice versa and side-to-side at up to approximately a 50° angle. The diameter of the central opening 16 is much smaller than the diameter of the semi flexible ball member 14 so that the ball member 14 does not pass through the central opening 16 of the platform 12. Also, the central opening 16 helps to hold the ball member 14 with its beveled groove 15.

Figure 4:
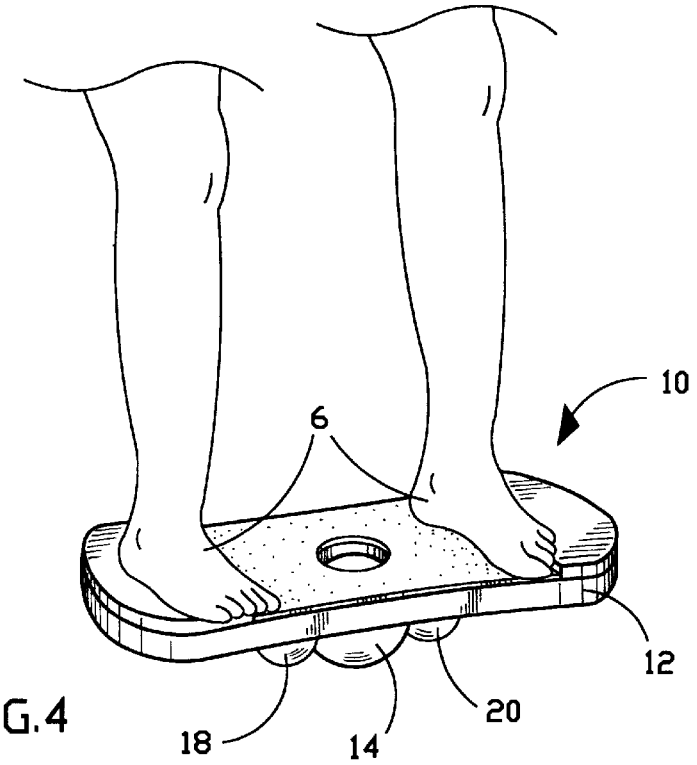
FIG. 4 is an illustration of the present invention balancing and exercising device, showing a basic stance arrangement to balance on the balancing and exercising device.

Referring to FIG. 4, there is shown a basic stance for balancing the platform 12. By way of example, the basic stance is to have the individual put his or her feet 6 parallel and spaced apart from each other and 90° to the platform 12, where the toes face forward and the platform 12 is in a transverse direction. The platform 12 is then balanced on the flexible ball member 14. By way of example, another stance is to have the individual put his or her feet parallel and close to each other and parallel to the platform 12, where the toes face forward and the platform 12 is in a longitudinal direction. It will be appreciated that the present invention balancing and exercising device 10 has numerous stances, for example, a one foot stance calf stretch. For a calf stretch, the user lays the board on its side, with one foot parallel to the board, the foot centered on the ball member 14, and stretches the calf forward. Another exercise by way of example is an inversion or eversion foot stance where both feet are facing toward one end of the balancing board which allows for a 50° angle of tilt. For another exercise by way of example, a dorsi-flexion stance is feet or heels backward on the platform (see FIG. 4), which allows for a 50° angle of tilt. For another exercise by way of example, a plantar flexion stance is toes toward each other which allows for a 50° angle of tilt. For another exercise by way of example, the stance is one foot is in the air while the other foot is placed on the platform 12. For another exercise by way of example, the stance is one foot is on the ground while the other foot is placed on the platform 12 allowing 50° angle of tilt of inversion eversion planter flexion and dorsi-flexion. All of these exercises can be performed with either left or right foot on the board with the other foot in the air or the other foot on the ground.

Figure 5:
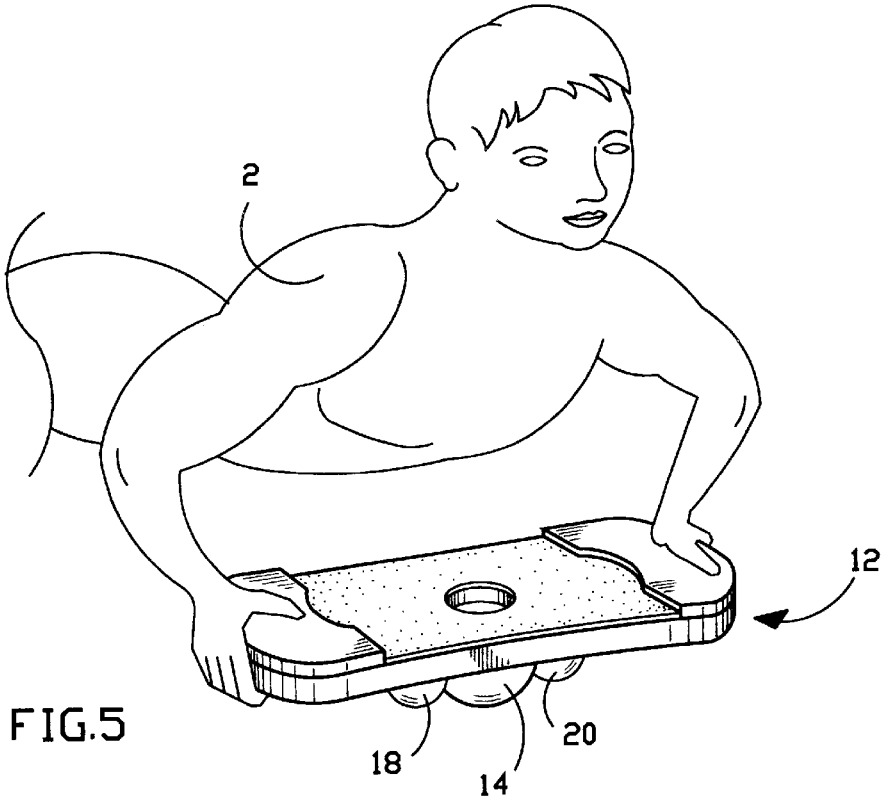
FIG. 5 is an illustration of the present invention balancing and exercising device, showing a push-up arrangement.
Figure 6:
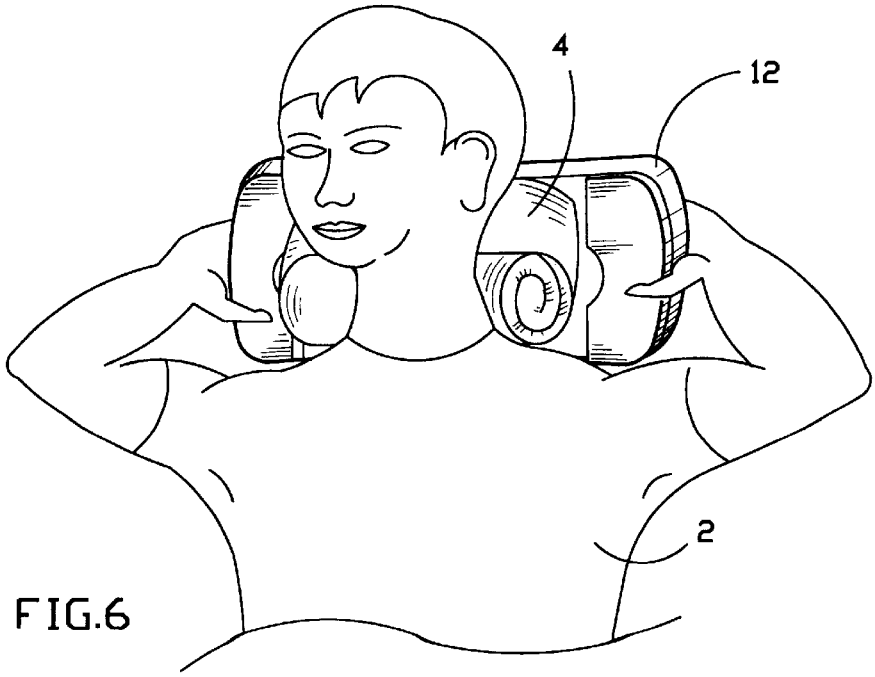
FIG. 6 is an illustration of the present invention balancing and exercising device, showing a sit-up arrangement.

Referring to FIG. 5, there is shown a further use of the present invention balancing and exercising device 10. The individual can perform push-ups on the platform 12 by using the hand grooves 26 and 28 or by making fists and putting the fists on the pads 22 and 24 while balancing on the pair of small ball-shaped rigid members 18 and 20 or on the single ball member 14. Referring to FIG. 6, there is shown a further use of the present invention balancing and exercising device 10, where the platform 12 assists an individual in sit-ups. A towel, pillow or foam pad 4 is provided with the platform and when formed properly can prevent neck injury and may be placed adjacent and on top of the platform 12 to provide neck support and then the gripping-hand grooves 26 and 28 are held in either hand behind the head to assist in performing sit-ups and also an individual can rest his or her head on the towel, pillow or foam pad 4 on the platform 12 and do leg lifts.

Referring to FIGS. 1 through 6, by way of example, the overall length and width of the board 10 may be approximately 15¼" (inches) by 7½" (inches) respectively. There are more degrees of motion possible due to the narrow rigid platform 12 when the side edges of the platform 12 touch the ground. For example, the amount of the angle between the horizontal ground and the side edges of the platform 12 can be extended to approximately 50°. It will be appreciated that the dimensions and angle described above are merely one illustrative embodiment and can include many other comparable sets of dimensions and angle as described below.

If an individual is standing on the rigid platform 12 with the semi flexible ball member 14 underneath the platform 12 and it tilts all the way to the left or right, the edge of the platform touching the ground forms an angle of approximately 50°. This is a much steeper angle than is usable with the prior art devices. By way of example: a 10½" wide platform, the degree of motion is 35°; in a 9" wide platform, the degree of motion is 40°; in an 8" wide platform, the degree of motion is 47°; in a 6½" wide platform, the degree of motion is 55°; and in a 5½" wide platform, the degree of motion is 65°.

The flexible ball member 14 is adapted to be compressed slightly flat so it can balance better when under pressure and the bottom portion 50 of the ball member 14 is able to pivot in any direction or plane. The platform 12 is placed on top of the semi flexible ball member 14 such that the central opening 16 accommodates a top portion 48 of the semi flexible ball member 14, and thereby allows the platform 12 to pivot in synchronization with the flexible ball member 14. As the platform 12 is pivoted in a particular direction, the flexible ball member 14 will pivot in that same direction. When an individual stands on the platform 12, the individual has the ability to balance in numerous directions and the amount of the angle between the ground and the side edges of the platform 12 can be extended to approximately 50°. Because the individual is balancing on a single ball, all 360° of motion may be reached while pivoting on the flexible ball member 14.

The balancing and exercising device improves an individual's balance for all sports, especially for sports when you stand on something and try to balance yourself, such as surfing and snowboarding. The balancing and exercising device accomplishes this by activating muscles to work in cooperation with one another for good bone movement. This interaction with the nervous and musculoskeletal systems improves balance, coordination, and quickens reflex time. These improvements occur by the stimulation of proprioceptors (little sensors at the end of the nerves) in the muscles, tendons, and joints. Proprioceptors, once stimulated by stretching movement, send a message to the brain by way of the nervous system and back down to the muscles informing the muscles of proper operation. Standing on the platform with a variety of stances (different positions of the feet on the board, or knees straight or bent, or squat) will cause an increased number of proprioceptors to be stimulated. This stimulation happens more so in the ankles, where there are a large number of proprioceptors. Ankle stimulation is very important because much of the body's balancing is done without feet and ankles while we are standing and walking. The inner ear is also stimulated by movement and this helps develop balance awareness. The increased angle of tilt in all directions of the balancing and exercising device makes it far superior for muscle, tendon, and joint stretching movements, thereby stimulating more proprioceptors. After the balancing and exercising device use, the muscles have better tone and the postural muscles go to work to help align the body's structure properly. The stretching movements of the ankles, legs, knees and back strengthen these areas to prevent injury and are good for rehabilitation. The end result is that the body is trained to perform better. The present invention balancing and exercising device is smaller and lighter than other balance boards.

The present invention conforms to conventional forms of manufacture or any other conventional way known to one skilled in the art, and is of simple construction and is easy to use. The platform 12 can be made from several materials. By way of example, the platform 12 can be made of plastic, wood or other suitable material.

It will be appreciated that the present invention is not limited to the semi flexible ball member 14. It is emphasized that while the semi flexible ball member 14 is the preferred shaped, it is also within the spirit and scope of the present invention to utilize different shape pivoting means such as a square shaped ball which is slightly rounded at its bottom surface. The shape of the balancing means determines the difficulty of balancing the platform 12 on the pivoting means.

Defined in detail, the present invention is a balancing and exercising device for an individual, comprising: (a) a large semi flexible ball being slightly compressible when under pressure and with a bottom portion which is pivotable in any direction; (b) a generally elongated rectangular shaped rigid platform having a top side, a bottom side, and a central opening therethrough; and (c) a pair of small ball-shaped rigid members mounted on said bottom side of said platform and located adjacent to and on opposite sides of said central opening for securing said semi flexible ball between them, said platform placed on top of said semi flexible ball such that said central opening accommodates a top portion of said semi flexible ball, where said semi flexible ball is below said top side of said platform, and thereby allows the platform to be independently pivoted front-to-back up to a 25° angle and vice versa and side-to-side up to a 50° angle, where the diameter of said central opening is smaller than the diameter of said semi flexible ball; (d) whereby when the individual stands on said platform, the individual has the ability to balance in numerous directions, which thereby provides muscle, tendon, and joint stretching movements.

Defined broadly, the present invention is a balancing device for an individual, comprising: (a) a balancing means being slightly compressible when under pressure and pivotable in any direction; (b) a rectangular shaped rigid board having a central opening therethrough; and (c) two retaining and rocking members mounted on said board and located adjacent to and on opposite sides of said central opening for securing said balancing means between them, said rigid board placed on top of said balancing means such that said central opening accommodates a portion of said balancing means, where the portion of said balancing means is below a top surface of said rigid board, where said rigid board is pivotable from side-to-side at approximately a 50° angle; (d) whereby when the individual stands on said rigid board, the individual has the ability to balance in numerous directions, which thereby provides muscle, tendon, and joint stretching movements.

Defined more broadly, the present invention is a balancing device for an individual, comprising: an elongated rigid board having at least two rocking members, the rigid board pivotable in side-to-side direction for balancing the rigid board, whereby when the individual stands on it, the individual has the ability to balance in side-to-side directions.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing fall public disclosure of at least one of its forms. However, such detailed description is not intended in any way to limit the broad features or principles of the present invention, or the scope of patent monopoly to be granted.

What is claimed is:

1. A balancing and exercising device for an individual, comprising:

a. a large semi flexible ball being slightly compressible when under pressure and with a bottom portion which is pivotable in any direction;

b. a generally elongated rectangular shaped rigid platform having a top side, a bottom side, and a central opening therethrough; and c. a pair of small ball-shaped rigid members mounted on said bottom side of said platform and located adjacent to and on opposite sides of said central opening for securing said semi flexible ball between them, said platform placed on top of said semi flexible ball such that said central opening accommodates a top portion of said semi flexible ball, where said semi flexible ball is below said top side of said platform, and thereby allows the platform to be independently pivoted front-to-back up to a 25° angle and vice versa and side-to-side up to a 50° angle, where the diameter of said central opening is smaller than the diameter of said semi flexible ball;

d. whereby when the individual stands on said platform, the individual has the ability to balance in numerous directions, which thereby provides muscle, tendon, and joint stretching movements.

2. The balancing and exercising device in accordance with claim 1 further comprising at least two opposite hand pads attached to said top side of said platform for accommodating the individual's hands or fists or knuckles.

3. The balancing and exercising device in accordance with claim 2 further comprising at least two opposite hand grooves located on said bottom side of said platform for accommodating the individual's fingers.

4. The balancing and exercising device in accordance with claim 1 wherein said platform can be balanced on said pair of small ball-shaped rigid members when the large semi flexible ball is removed.

5. The balancing and exercising device in accordance with claim 1 wherein said rigid platform further has rounded corners.

6. A balancing device for an individual, comprising:

a. a balancing means being slightly compressible when under pressure and pivotable in any direction;

b. a rectangular shaped rigid board having a central opening therethrough; and c. two retaining and rocking members mounted on said board and located adjacent to and on opposite sides of said central opening for securing said balancing means between them, said rigid board placed on top of said balancing means such that said central opening accommodates a portion of said balancing means, where the portion of said balancing means is below a top surface of said rigid board, where said rigid board is pivotable from side-to-side at approximately up to a 50° angle;

d. whereby when the individual stands on said rigid board, the individual has the ability to balance in numerous directions, which thereby provides muscle, tendon, and joint stretching movements.

7. The balancing device in accordance with claim 6 further comprising at least two opposite hand pads attached to said rigid board for accommodating the individual's hands or fists or knuckles.

8. The balancing device in accordance with claim 7 further comprising at least two hand grooves located on opposite side of said at least two opposite hand pads for further accommodating the individual's fingers.

9. The balancing device in accordance with claim 6 wherein said rigid board can be balanced on said two retaining and rocking members when the balancing means is removed.

10. The balancing device in accordance with claim 6 wherein said rigid board further comprises rounded corners.

11. The balancing device in accordance with claim 6 wherein said balancing means includes a large semi flexible ball member.

12. The balancing device in accordance with claim 6 wherein said two retaining and rocking members are two small ball-shaped rigid members.

* * * * *